US010706761B2

(12) United States Patent
Li et al.

(10) Patent No.: US 10,706,761 B2
(45) Date of Patent: Jul. 7, 2020

(54) CONTROL METHOD FOR DISPLAY PANEL

(71) Applicant: WUHAN TIANMA MICRO-ELECTRONICS CO., LTD., Wuhan (CN)

(72) Inventors: Yue Li, Shanghai (CN); Renyuan Zhu, Shanghai (CN); Dongxu Xiang, Shanghai (CN); Yana Gao, Shanghai (CN); Xingyao Zhou, Shanghai (CN)

(73) Assignee: WUHAN TIANMA MICRO-ELECTRONICS CO., LTD., Wuhan (CN)

( * ) Notice: Subject to any disclaimer, the term of this patent is extended or adjusted under 35 U.S.C. 154(b) by 99 days.

(21) Appl. No.: 15/963,051

(22) Filed: Apr. 25, 2018

(65) Prior Publication Data

US 2018/0240389 A1 Aug. 23, 2018

(30) Foreign Application Priority Data

Nov. 30, 2017 (CN) ..... 2017 1 1235382

(51) Int. Cl.
*G09G 3/20* (2006.01)
*G09G 3/3275* (2016.01)

(52) U.S. Cl.
CPC ..... *G09G 3/2003* (2013.01); *G09G 3/3275* (2013.01); *G09G 2300/0819* (2013.01); *G09G 2300/0861* (2013.01); *G09G 2310/0205* (2013.01); *G09G 2310/0251* (2013.01); *G09G 2310/0297* (2013.01)

(58) Field of Classification Search
CPC ..... G09G 3/2003; G09G 3/3275; G09G 3/20; G09G 2310/0297; G09G 2310/0251; G09G 2300/0861; G09G 2300/0891; G09G 2310/0205
See application file for complete search history.

(56) References Cited

U.S. PATENT DOCUMENTS

2003/0090451 A1 5/2003 Ahn
2007/0242016 A1* 10/2007 Choi ..... G09G 3/3233 345/92
2009/0230402 A1* 9/2009 Lee ..... H01L 27/12 257/72
2012/0299983 A1* 11/2012 Chang ..... G09G 3/3614 345/691
2016/0019842 A1* 1/2016 Kim ..... G09G 3/3291 345/694

FOREIGN PATENT DOCUMENTS

CN 1417771 A 5/2003

* cited by examiner

*Primary Examiner* — Alexander Eisen
*Assistant Examiner* — Kebede T Teshome
(74) *Attorney, Agent, or Firm* — Kilpatrick Townsend & Stockton, LLP

(57) ABSTRACT

A control method for a display panel is provided, the display panel includes multiple gate lines, multiple data lines arranged to intersect with the gate lines in an insulative manner, multiple sub-pixels arranged in an array and a demultiplexer. The N data lines for charging the sub-pixels with different colors are connected to one signal input terminal through the demultiplexer, N is an integer greater than 1. The control method includes charging the sub-pixels connected to the demultiplexer in a direct charging manner, and the sub-pixels with the same color have the same charging time period in a preset period.

17 Claims, 13 Drawing Sheets

CONTROL METHOD FOR DISPLAY PANEL

CROSS REFERENCE TO RELATED APPLICATION

The present application claims priority to Chinese Patent Application No. 201711235382.6, titled "CONTROL METHOD FOR DISPLAY PANEL", filed on Nov. 30, 2017 with the State Intellectual Property Office of the People's Republic of China, which is incorporated herein by reference in its entirety.

FIELD

The present disclosure relates to the technical field of display, and particularly to a control method for a display panel.

BACKGROUND

At present, a display device generally includes a display panel and a driving circuit. The display panel includes multiple sub-pixels arranged in an array, and the driving circuit includes a gate driving circuit for driving gate lines and a data driving circuit for driving data lines. In order to reduce cost of the display device, it is desirable to reduce the number of output channels of the data driving circuit without reducing a resolution rate. Based on this, as shown in FIG. 1, a demultiplexer (Demux) 01 is used in the display panel, to connect a pair of data lines to one of a data signal input terminal IN(1), a data signal input terminal IN(2), . . . , or a data signal input terminal IN(n), and one data signal input terminal is connected to one output channel of the data driving circuit, in this way, the number of output channels of the data driving circuit can be reduced by one-half. In the Demux circuit generally used, charging timing sequence for charging the sub-pixels includes line charging and direct charging. The line charging is unsuitable in a display device with a high resolution ratio (pixels per inch (PPI)). The direct charging is suitable in the display panel with the high PPI. However, the direct charging has a problem that there is vertical striping in display of the display panel.

SUMMARY

In view of this, a control method for a display panel is provided in the present disclosure, to solve the problem in the conventional technology that vertical striping occurs in the display panel with a high PPI when sub-pixels are charged in the direct charging manner.

In order to realize the above objective, the following technical solutions are provided in the present disclosure.

A control method for a display panel is provided. The display panel includes: multiple gate lines, multiple data lines arranged to intersect with the gate lines in an insulative manner, multiple sub-pixels arranged in an array and a demultiplexer. The sub-pixels with different colors from each other connected to the same gate line constitute a repeat unit, N data lines for charging the sub-pixels with different colors from each other are connected to one signal input terminal through the demultiplexer, N is an integer greater than 1. The control method includes: providing a scanning signal to the gate line in each row to perform progressive scan; and turning on the demultiplexer to charge the sub-pixels connected to the demultiplexer when the scanning signal is inputted. Timing sequence control signals corresponding to the data lines have a same turn-on duration. The sub-pixels with the same color have the same charging time period in a preset period.

BRIEF DESCRIPTION OF THE DRAWINGS

In order to more clearly illustrate the technical solution in the embodiments of the present disclosure, in the following, drawings required in the description of the embodiments will be introduced simply. Apparently, the drawings in the following description show only some embodiments of the present disclosure.

DETAILED DESCRIPTION

As described in the background part, a problem of vertical striping in display of the display panel is caused by the direct charging manner in the conventional technology.

Figure 1:
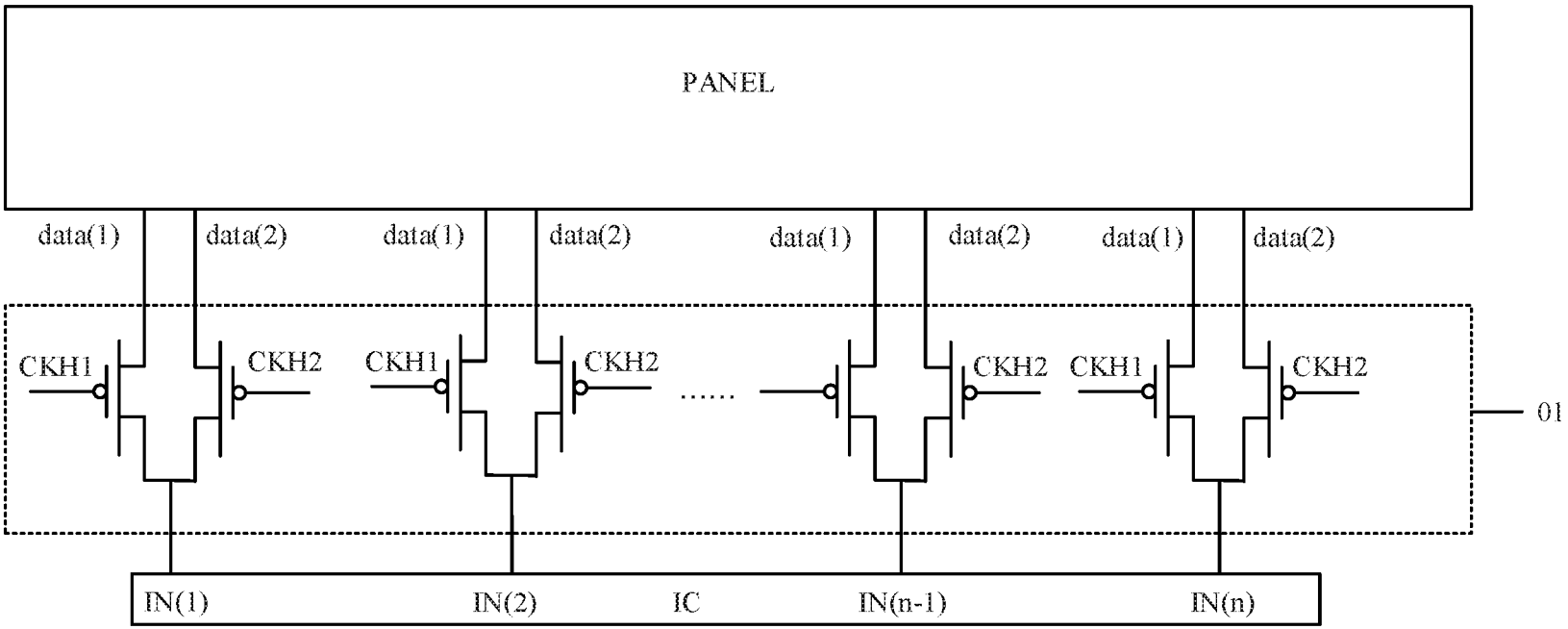
FIG. 1 is a schematic structural diagram of a demux circuit.
Figure 2:
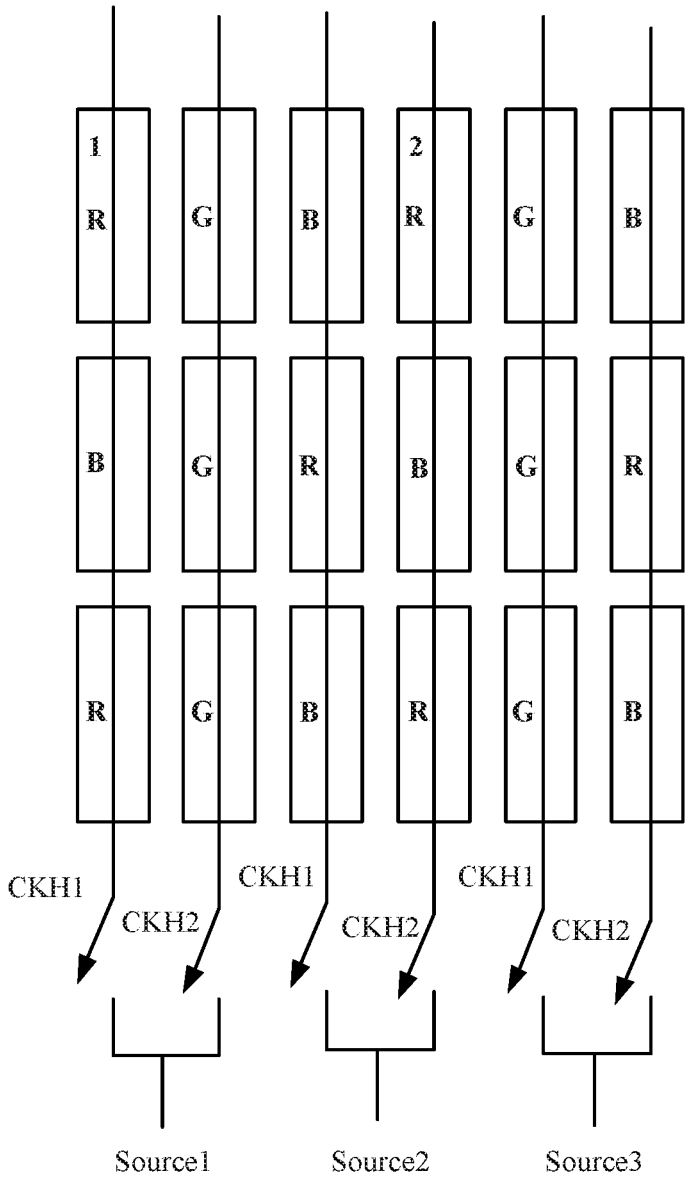
FIG. 2 is schematic diagram showing pixel array arrangement and a connection of a demux circuit.
Figure 3:
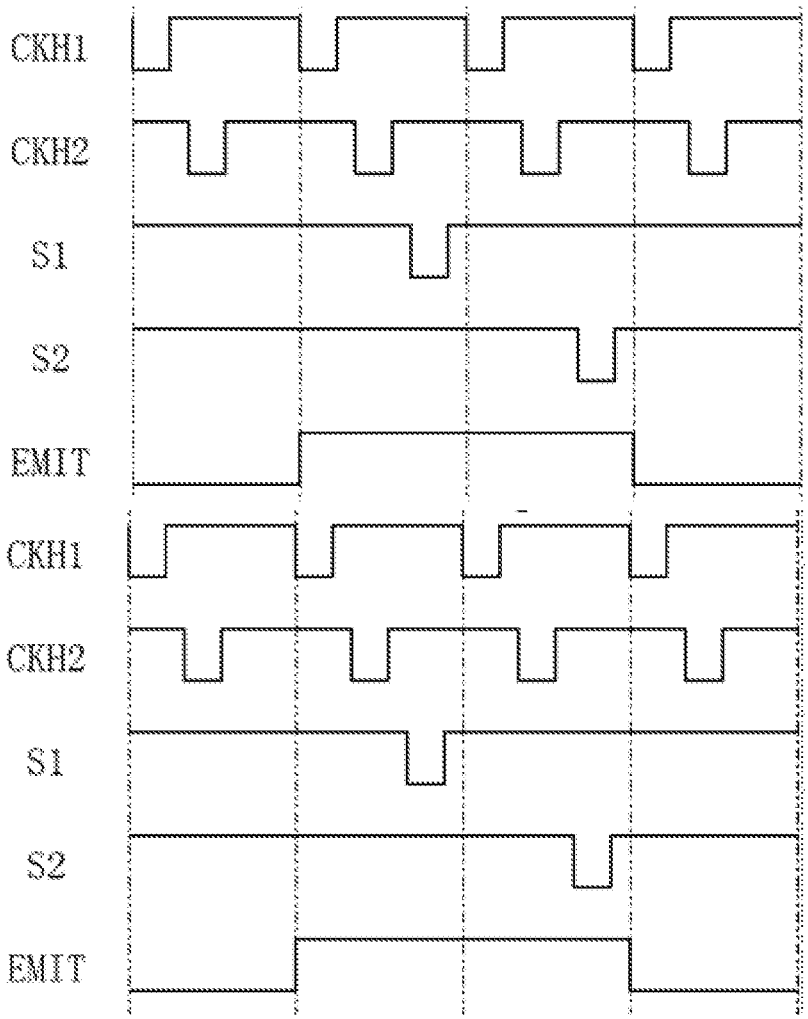
FIG. 3 is a schematic diagram showing control timing sequence of line charging in the pixel array arrangement shown in FIG. 2.
Figure 4:
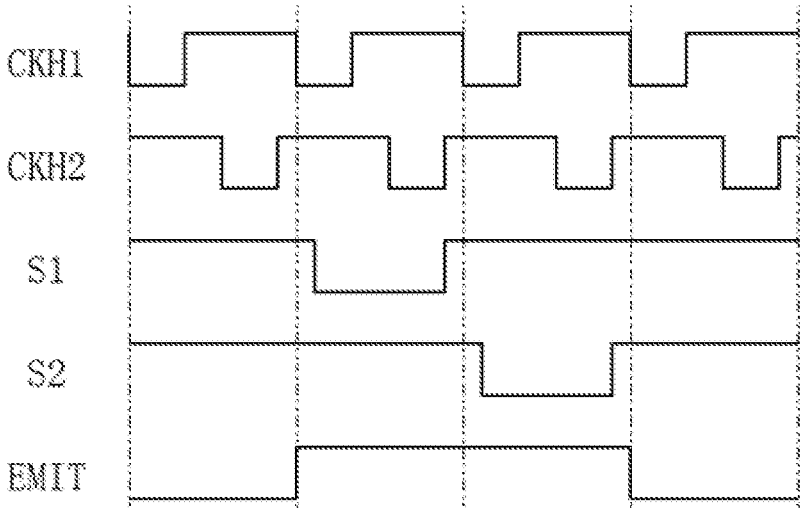
FIG. 4 is a schematic diagram showing control timing sequence of direct charging in the pixel array arrangement shown in FIG. 2.

When the sub-pixels are charged using the demutiplexer, the gate lines are turned on row by row. By loading a clock pulse signal into clock control signal lines sequentially, a data signal is loaded into data lines connected with the demultiplexer in a time division manner, to charge the sub-pixels in a row. In the Demux circuit generally used in the conventional technology, charging timing sequence for charging the sub-pixels includes line charging and direct charging. Reference is made to FIG. 2, FIG. 3 and FIG. 4. FIG. 2 is a schematic diagram showing pixel array arrangement and a connection of the demux circuit in conventional technology, each of data (Source 1, Source 2, Source 3) is connected to two data lines through CKH1 and CKH2, to charge sub-pixels in two columns. FIG. 3 is a schematic diagram showing control timing sequence of line charging, in which, CKH1 and CKH2 are turned on sequentially before gate line S2 is turned on, to transmit to-be-written data to the data lines, and the data is maintained by a parasitic capacitance, and then S2 is turned on, and the data maintained in the data lines is written into the sub-pixels. FIG. 4 is a schematic diagram showing control timing sequence of direct charging, in which, CKH1 and CKH2 are turned on sequentially while gate line S2 is turned on, data is written directly into the sub-pixels after CKH1 and CKH2 are turned on, other than being written and maintained in the data lines.

Advantages of the line charging includes the same charging time period for data lines in two columns controlled by CKH1 and CKH2 and even display of the pixel, however, a horizontal scanning frequency is reduced, and the line charging is unsuitable in a display device with a high resolution ratio (pixels per inch (PPI)), the horizontal scanning frequency is reduced with the increase of the PPI. As shown in FIG. 3, a scanning time period for one row is divided into three parts, in this case, time for capturing a threshold is too short, and it is unable to be suitable in a display panel with a high PPI.

It can be known by comparing FIG. 3 with FIG. 4 that as compared with the line charging, the scanning time period for one row can be utilized at a large extent in the direct charging, for example, S2 is in a turned-on state for a long time, therefore, there is sufficient time to capture the threshold, and the direct charging can be suitable in the display panel with the high PPI. However, data lines in two columns have different charging time periods in the direct charging, which results in vertical striping in display of the display panel.

An urgent problem to be solved in an application of the demux circuit into the display panel with the high PPI is how to solve the problem of vertical striping in display of the display panel in the direct charging manner.

Figure 5:
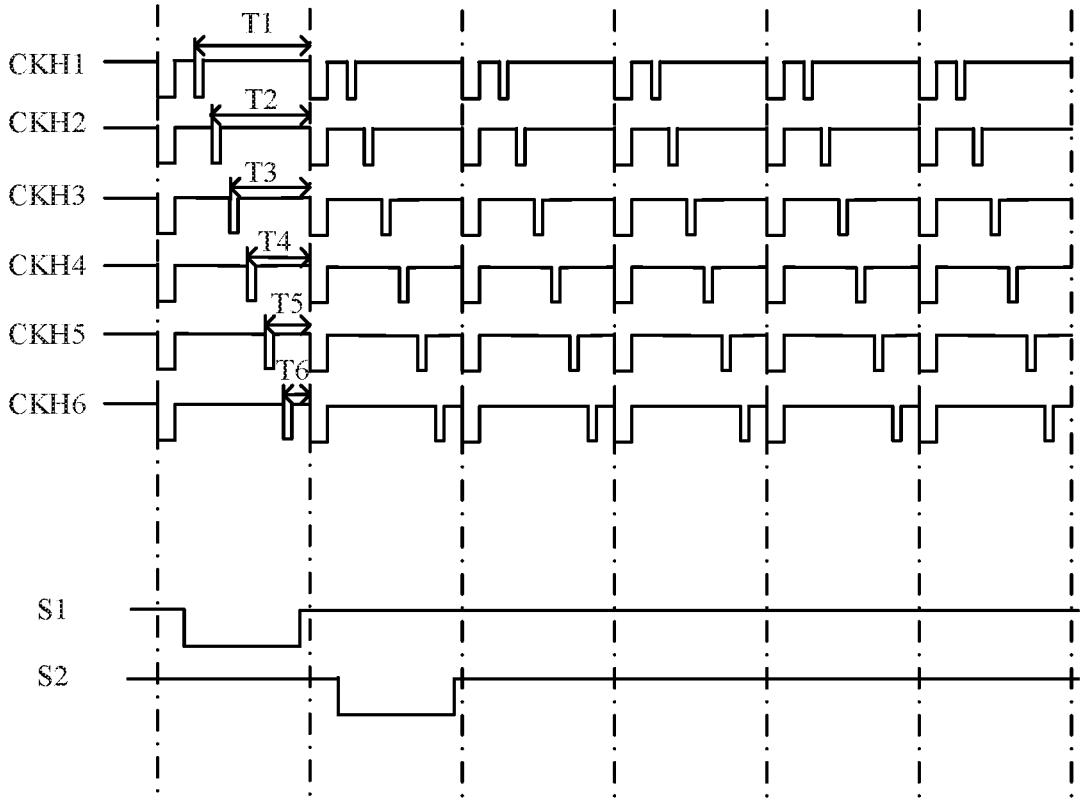
FIG. 5 is a schematic diagram showing control timing sequence of a 1:6 demux circuit.
Figure 6:
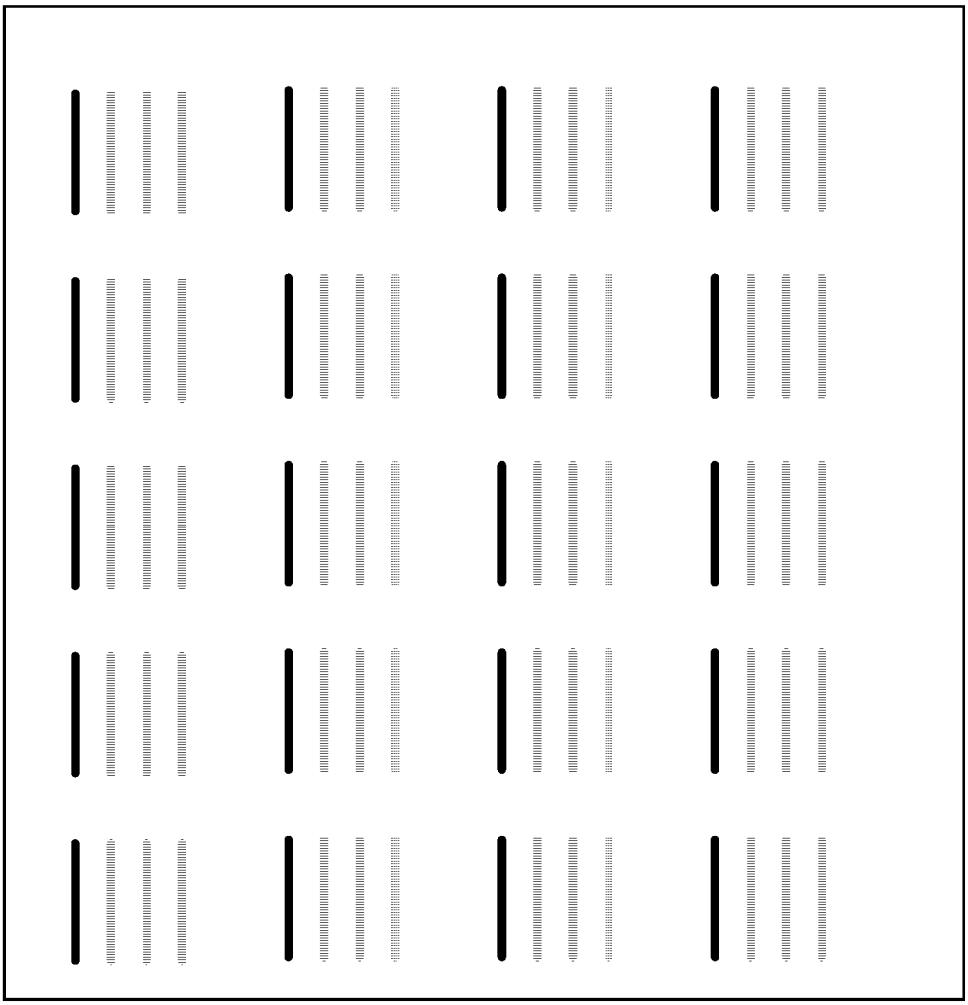
FIG. 6 is a schematic diagram showing a display image in a display panel controlled with the control timing sequence shown in the schematic diagram of FIG. 5.

A reason for the above problem is that a charging time period for a data line in a column is different from a charging time period for a data line in another column in a case that the sub-pixels are charged in the direct charging manner. Reference is made to FIG. 5, which is a control timing sequence diagram of a 1:6 demux circuit in the conventional technology. With the direct charging, a time instant when data is written into a sub-pixel in a column is different from a time instant when data is written into a sub-pixel in another column, therefore, the sub-pixels in different columns have different brightness, and uneven display is caused. For example, data is written into a data line controlled by CKH1 firstly, a charging time period T1 for the data line controlled by CKH1 is the longest, data is written successively into data lines respectively controlled by CKH2, CKH3, CKH4, CKH5 and CKH6 at an interval of one turn-on time period, and charging time periods T2, T3, T4, T5 and T6 for the data lines controlled by CKH2, CKH3, CKH4, CKH5 and CKH6 are decreased successively. In this way, vertical striping as shown in FIG. 6 occurs in display.

Based on this, a control method for a display panel is provided in the present disclosure, the display panel includes: multiple gate lines, multiple data lines arranged to intersect with the gate lines in an insulative manner, multiple sub-pixels arranged in an array and a demultiplexer. The sub-pixels with different colors from each other connected to the same gate line constitute a repeat unit. The N data lines for charging the sub-pixels with different colors from each other are connected to one signal input terminal through the demultiplexer, N is an integer greater than 1.

The control method includes: providing a scanning signal to the gate line in each row to perform progressive scan; and turning on the demultiplexer to charge the sub-pixels connected to the demultiplexer when the scanning signal is inputted. Timing sequence control signals corresponding to data lines have the same turn-on duration. The sub-pixels with the same color have the same charging time period in a preset period.

A sequence of writing data into data lines corresponding to the demux circuit is changed in the preset period, so that the sub-pixels with the same color have the same charging time period, thereby avoiding vertical striping in display of the display panel caused in a case that the sub-pixels in the same column have the same charging time period and the sub-pixels in different columns have different charging time periods.

A control method for a display panel is provided according to an embodiment of the present disclosure. The control method for the display panel includes: providing a scanning signal to a gate line in each row to perform progressive scan; and turning on a demultiplexer, to charge the sub-pixels connected to the demultiplexer when the scanning signal is inputted. Timing sequence control signals corresponding to all data lines have the same turn-on duration. The sub-pixels with the same color have the same charging time period in a preset period.

It should be illustrated that the control method for the display panel in the present disclosure is applied to the display panel in which the sub-pixels with different colors are arranged in one column. In one embodiment, the display panel according to the embodiment includes: multiple gate lines, multiple data lines arranged to intersect with the gate lines in an insulative manner, multiple sub-pixels arranged in an array, and a demultiplexer. The sub-pixels with different colors from each other connected to the same gate line constitute a repeat unit. The N data lines for charging the sub-pixels with different colors from each other are connected to one signal input terminal through the demultiplexer, N is an integer greater than 1.

The multiple sub-pixels with different colors are arranged in one column. In the preset period, the sub-pixels with the same color have the same brightness in a case that the sub-pixels with the same color have the same charging time period, and the sub-pixels with different colors may have the same charging time period or different charging time periods. In this case, the sub-pixels in the same column may have different charging time periods, thereby avoiding the vertical striping.

The core concept of the present disclosure is described above, with which, control timing sequence of the demur circuit in the display panel is changed, so that in the preset period, the sub-pixels with the same color in the display panel have the same charging time period and the sub-pixels with different colors in the same column have different charging time periods, thereby avoiding the vertical striping.

A control method for a display panel in a case that the preset period is display time of one frame of image is provided according to an embodiment of the present disclosure.

Figure 7:
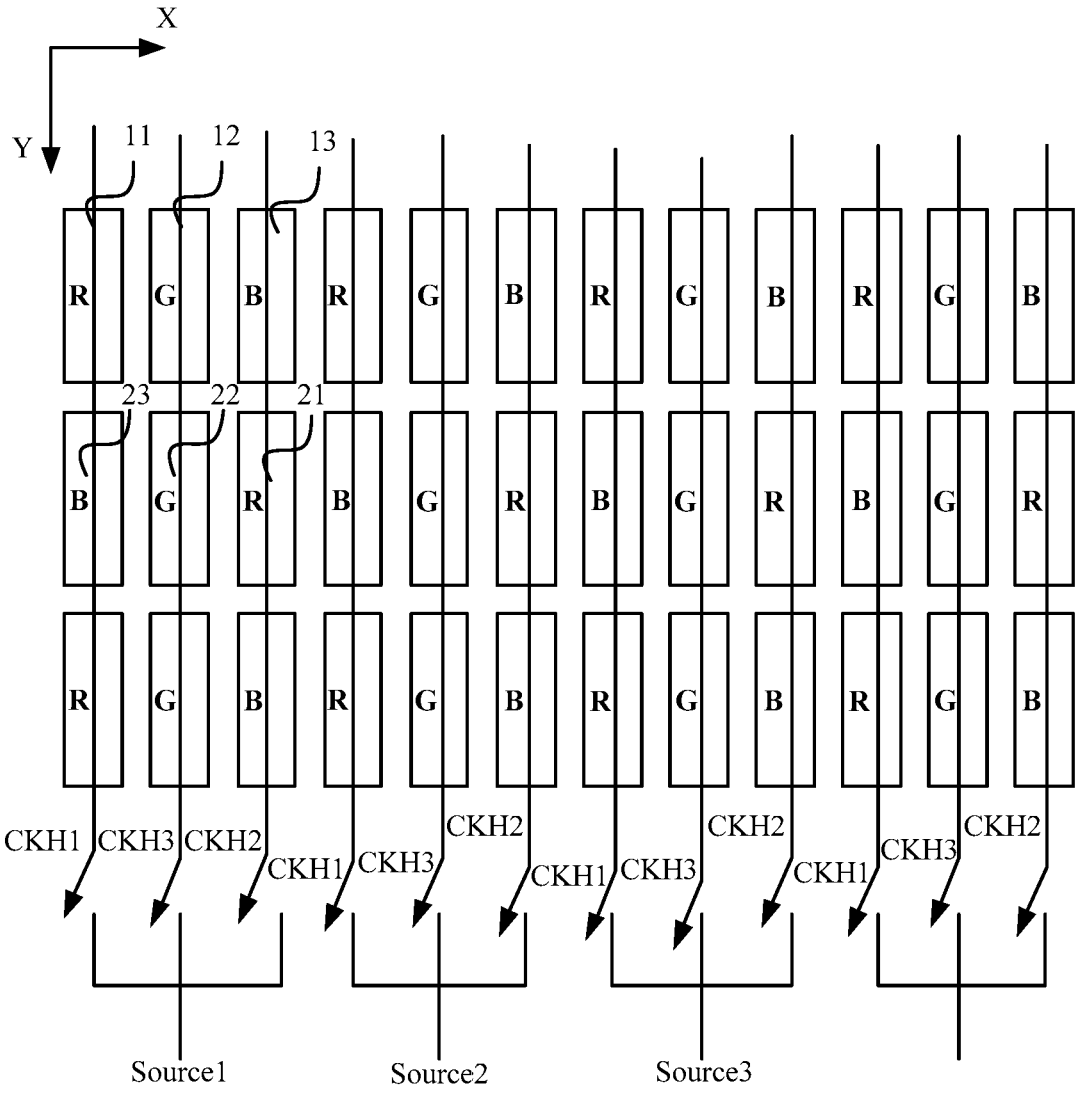
FIG. 7 is a schematic diagram showing a pixel driving device of a display panel according to an embodiment of the present disclosure.

With reference to FIG. 7, which is a schematic diagram showing a pixel driving device of a display panel according to an embodiment of the present disclosure, the pixel driving device includes a first sub-pixel driving unit 11, a second sub-pixel driving unit 12 and a third sub-pixel driving unit 13. A first sub-pixel driving unit row and a second sub-pixel driving unit row are arranged alternately in an extension direction (a direction Y in FIG. 7) of the data line. The first sub-pixel driving unit row includes the first sub-pixel driving unit 11, the second sub-pixel driving unit 12 and the third sub-pixel driving unit 13 arranged sequentially in an extension direction (a direction X in FIG. 7) of the gate line. The second sub-pixel driving unit row includes the third sub-pixel driving unit 23, the second sub-pixel driving unit 22 and the first sub-pixel driving unit 21 arranged sequentially in the extension direction (the direction X in FIG. 7) of the gate line. In the extension direction (the direction Y in FIG. 7) of the data line, the first sub-pixel driving unit 11 in the first sub-pixel driving unit row and the third sub-pixel driving unit 23 in the second sub-pixel driving unit row are arranged alternately. Three data lines for charging the first sub-pixel driving unit 11, the second sub-pixel driving unit 12 and the third sub-pixel driving unit 13 in the first sub-pixel driving unit row are connected to one signal input terminal via one demultiplexer.

It should be illustrated that colors of sub-pixels corresponding to the first sub-pixel driving unit (11, 21), the second sub-pixel driving unit (12, 22) and the third sub-pixel driving unit (13, 23) are not limited in the embodiment. In the embodiment, the first sub-pixel driving unit (11, 21) is a red pixel driving unit, and the second sub-pixel driving unit (12, 22) is a green pixel driving unit, and the third sub-pixel driving unit (13, 23) is a blue pixel driving unit. In other embodiment of the present disclosure, there may be other pixel arrangement.

Figure 8:
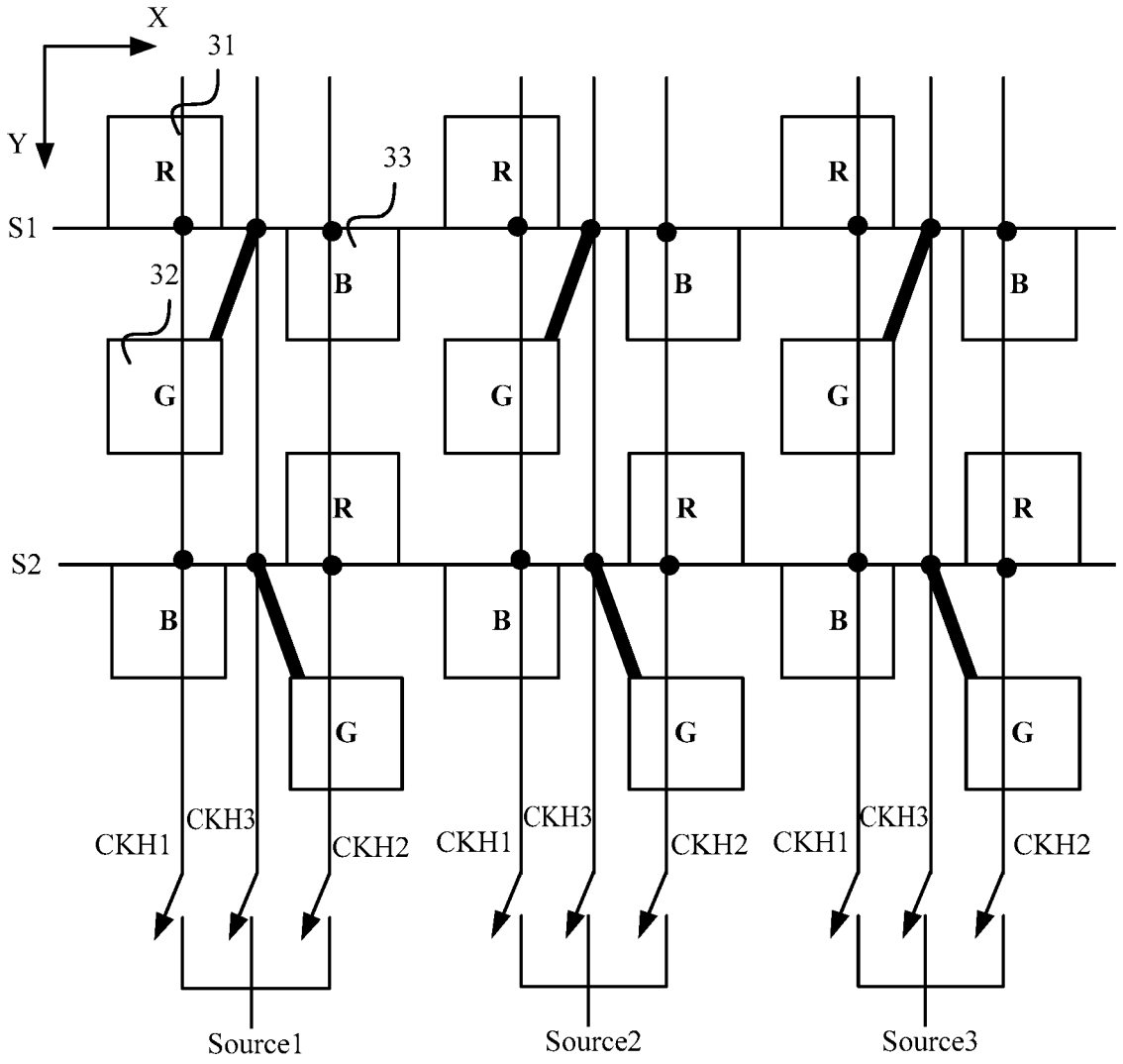
FIG. 8 is a schematic diagram showing pixel arrangement according to an embodiment of the present disclosure corresponding to the pixel driving device shown in FIG. 7.

Correspondingly, sub-pixel arrangement in the display panel is as shown in FIG. 8. The display panel includes a first sub-pixel 31, a second sub-pixel 32 and a third sub-pixel 33, which correspond to the sub-pixel driving units in FIG. 7. In the embodiment, the first sub-pixel 31 is a red pixel, the second sub-pixel 32 is a green pixel, and the third sub-pixel 33 is a blue pixel.

The display panel includes a first sub-pixel row, a third sub-pixel row and a second sub-pixel row arranged sequentially in an extension direction (a direction Y in FIG. 8) of the data line. In an extension direction (a direction X in FIG. 8) of the gate line, the first sub-pixel row includes multiple first sub-pixels 31, the second sub-pixel row includes multiple second sub-pixels 32, and the third sub-pixel row includes multiple third sub-pixels 33. In the extension direction (the direction Yin FIG. 8) of the data line, the first sub-pixel 31 and the second sub-pixel 32 are arranged alternately. In the extension direction (the direction X in FIG. 8) of the gate line, the third sub-pixel 33 is arranged between the first sub-pixel 31 and the second sub-pixel 32.

Based on the above display panel, the control method for the display panel in the present disclosure includes: during scanning the gate line in an odd row and the gate line in an even row, keeping an unchanged rank of a turn-on level occurring in the timing sequence control signal corresponding to the data line for charging the second sub-pixel driving unit 12 in the first sub-pixel driving unit row in a sequence of turn-on levels occurring in the timing sequence control signals corresponding to the data lines for charging the first sub-pixel driving unit, the second sub-pixel driving unit and the third sub-pixel driving unit; when switching between an operation of scanning the gate line in an odd row and an operation of scanning the gate line in an even row, exchanging a rank of a turn-on level occurring in the timing sequence control signal corresponding to the data line for charging the first sub-pixel driving unit 11 in the first sub-pixel driving unit row in the sequence with a rank of a turn-on level occurring in the timing sequence control signal corresponding to the data line for charging the third sub-pixel driving unit 13 in the first sub-pixel driving unit row in the sequence.

It should be illustrated that in the embodiment of the present disclosure, the first sub-pixel driving unit in the first sub-pixel driving unit row and the third sub-pixel driving unit in the second sub-pixel driving unit row are arranged alternately in the extension direction of the data line. In the embodiment, correspondingly, in order that the pixels with the same color have the same charging time period, the data line corresponding to the first sub-pixel driving unit in the first sub-pixel driving unit row is charged before the data line corresponding to the third sub-pixel driving unit in the first sub-pixel driving unit row is charged when scanning the gate line in the odd row, and the data line corresponding to the third sub-pixel driving unit in the first sub-pixel driving unit row is charged before the data line corresponding to the first sub-pixel driving unit in the first sub-pixel driving unit row is charged when scanning the gate line in the even row. That is, the rank of the turn-on level occurring in the timing sequence control signal corresponding to the data line for charging the first sub-pixel driving unit in the sequence is exchanged with the rank of the turn-on level occurring in the timing sequence control signal corresponding to the data line for charging the third sub-pixel driving unit in the same row as the first sub-pixel driving unit in the sequence when switching between a step of scanning the gate line in the odd row and a step of scanning the gate line in the even row.

The sequence of the turn-on levels occurring in the timing sequence control signals corresponding to the data lines for charging the first sub-pixel driving unit, the second sub-pixel driving unit and the third sub-pixel driving unit in the first sub-pixel driving unit row in the demultiplexer is not limited in the embodiment.

Figure 9:
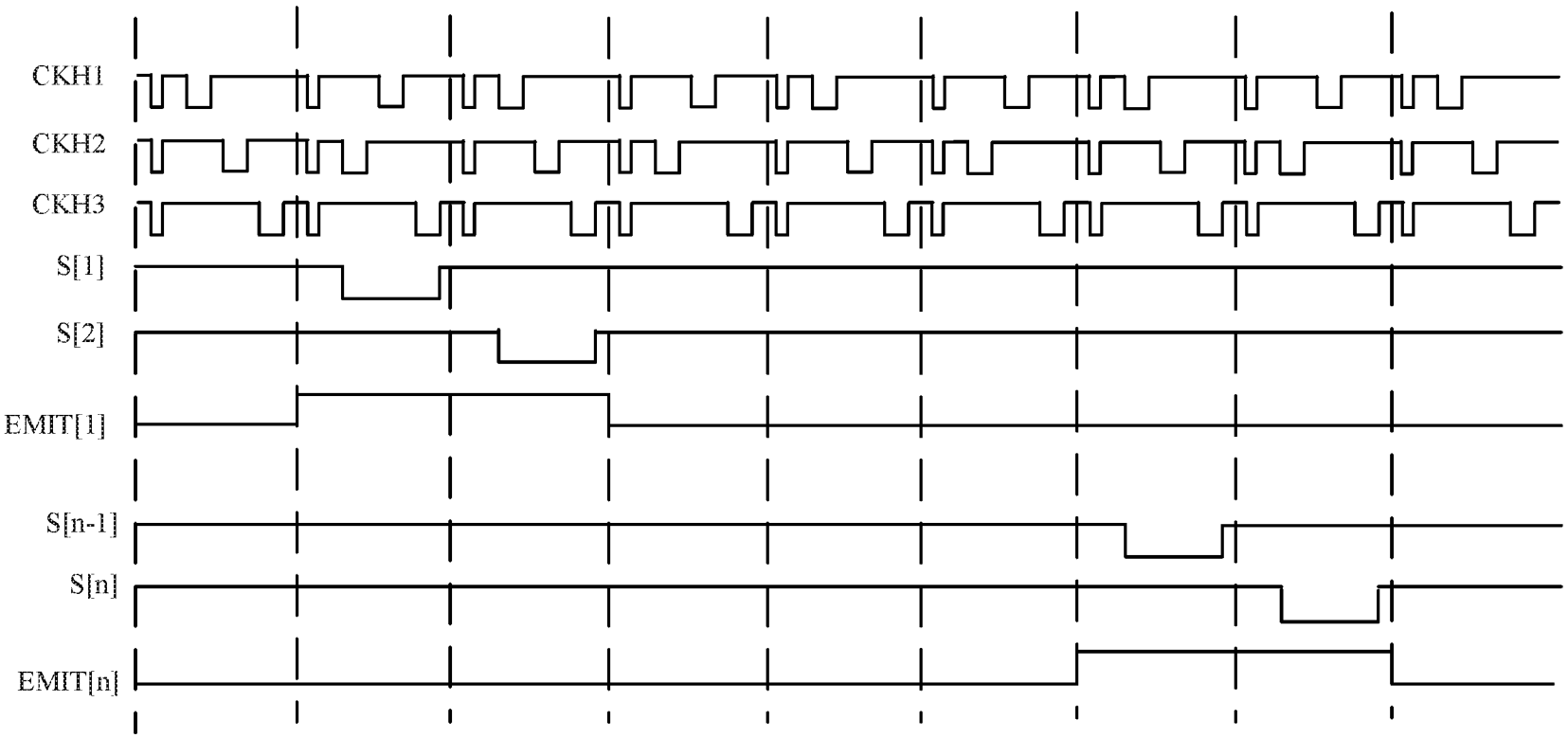
FIG. 9 is a schematic timing sequence diagram of a control method for a display panel including a 1:3 demux circuit according to an embodiment of the present disclosure.

Reference is made to FIG. 9, which is a timing sequence diagram of a control method for a display panel according to the embodiment of the present disclosure. When the gate line in the first row is turned on, that is, S[1] is at a low level and the pixels in the first row are scanned, a sequence of turning on CKH1, CKH2, and CKH3 is that CKH2 is turned on firstly, and CHK1 is turned on secondly and CKH3 is turned on thirdly. Correspondingly to the pixel driving device in FIG. 7, the length of the charging time period is represented as a charging time period of the blue sub-pixel B driving unit in the first row>a charging time period of the red sub-pixel R driving unit in the first row>a charging time period of the green sub-pixel G driving unit in the first row. When the gate line in the second row is turned on, that is, S[2] is at a low level and the pixels in the second row are scanned, a sequence of turning on CKH1, CKH2, and CKH3 is that CKH1 is turned on firstly, and CHK2 is turned on secondly and CKH3 is turned on thirdly. Correspondingly to the pixel driving device in FIG. 7, the length of the charging time period is represented as a charging time period of the blue sub-pixel B driving unit in the second row>a charging time period of the red sub-pixel R driving unit in the second row>a charging time period of the green sub-pixel G driving unit in the second row.

It can be seen from the above description that both in the odd row and the even row, the charging time period of the blue sub-pixel B driving unit is the longest, followed by the charging time period of the red sub-pixel R driving unit, and the charging time period of the green sub-pixel G driving unit is the shortest. That is, the sub-pixels with the same color have the same charging time period, and the sub-pixels with different colors in the same column have different charging time periods. In this case, multiple sub-pixels in the same column have different display brightness, and there is a sub-pixel in a column which has the same brightness as the sub-pixel in another column, thereby avoiding the vertical striping caused by a brightness difference between columns.

In the embodiment of the present disclosure, as shown in FIG. 9, in the demultiplexer, a sequence of the turn-on levels occurring in the timing sequence control signals corresponding to the data lines for charging the first sub-pixel driving unit, the second sub-pixel driving unit and the third sub-pixel driving unit in the first sub-pixel driving unit row is that: the turn-on level occurs firstly in the timing sequence control signal corresponding to the data line for charging the first sub-pixel driving unit, and the turn-on level occurs secondly in the timing sequence control signal corresponding to the data line for charging the third sub-pixel driving unit, and the turn-on level occurs thirdly in the timing sequence control signal corresponding to the data line for charging the second sub-pixel driving unit.

That is, a rank of the turn-on level occurring in the timing sequence control signal CKH3 corresponding to the data line for charging the second sub-pixel G driving unit in the sequence of the turn-on levels occurring in the timing sequence control signals CKH1, CKH2 and CKH3 corresponding to the data lines for charging the first sub-pixel R driving unit, the second sub-pixel G driving unit and the third sub-pixel B driving unit remains unchanged, and the turn-on level occurs last in the timing sequence control signal CHK3. Ranks of the turn-on levels occurring in the timing sequence control signal CKH1 and CHK2 corresponding to the data lines for charging the first sub-pixel R driving unit and the third sub-pixel B driving unit in the sequence are exchanged with each other when the process is performed from a step of scanning one row to a step of scanning a row adjacent the one row, thereby compensating uneven brightness of the pixels in a direction of the column and ensuring the same compensation time for all colors.

In other embodiments of the present disclosure, the sequence of the turn-on level occurring in the timing sequence control signal with the unchanged rank and the two timing sequence control signals, the ranks of which are exchanged with each other, is not limited. The rank of the turn-on level occurring in the timing sequence control signal CKH3 with the unchanged rank may be set ahead of the ranks of the turn-on levels occurring in CKH1 and CKH2 in the sequence, may be set behind the ranks of the turn-on levels occurring in CKH1 and CKH2 in the sequence, or may be set between the ranks of the turn-on levels occurring in CKH1 and CKH2 in the sequence.

That is, the sequence of the turn-on levels occurring in the timing sequence control signals corresponding to the data lines for charging the first sub-pixel driving unit, the second sub-pixel driving unit and the third sub-pixel driving unit in the first sub-pixel driving unit row in the demultiplexer may also be that: the turn-on level occurs firstly in the timing sequence control signal corresponding to the data line for charging the first sub-pixel driving unit, and the turn-on level occurs secondly in the timing sequence control signal corresponding to the data line for charging the second sub-pixel driving unit, and the turn-on level occurs thirdly in the timing sequence control signal corresponding to the data line for charging the third sub-pixel driving unit, alternatively, may also be that: the turn-on level occurs firstly in the timing sequence control signal corresponding to the data line for charging the second sub-pixel driving unit, and the turn-on level occurs secondly in the timing sequence control signal corresponding to the data line for charging the first sub-pixel driving unit, and the turn-on level occurs thirdly in the timing sequence control signal corresponding to the data line for charging the third sub-pixel driving unit.

In the 1:3 demux circuit in the embodiment of the present disclosure, the sequence of the turn-on levels occurring in the timing sequence control signals of the demux circuit in the display panel is changed, so that the sub-pixels with the same color in the display panel have the same charging time period, thereby avoiding vertical striping caused by uneven brightness of the sub-pixels in different columns with the direct charging, and improving applicability of the demux circuit in the display panel with a high PPI.

It should be illustrated that the preset period in the above embodiment is display time of one frame of image. In the one frame of image, the sub-pixels with the same color have the same charging time period, and the sub-pixels with different colors have different charging time periods. For example, in the pixel driving device shown in FIG. 7, the length of the charging time periods is represented as: the charging time period of the blue sub-pixel B driving unit in the first row>the charging time period of the red sub-pixel R driving unit in the first row>the charging time period of the green sub-pixel G driving unit in the first row. Although the problem of vertical stripping is solved, blue may be bright and green may be dark in a displayed image after multiple frames of image are displayed, which results in a color difference.

In view of this, a control method for a display panel in a case of the preset period being display time of N frames of image is provided according to another embodiment of the present disclosure, to further avoid the color difference while solving the problem of vertical striping in the display panel.

A value of N for the display time of N frames of image is not limited in the embodiment, and the demux circuit can be applied in a case of any value of N, therefore, N is an integer greater than 1. In the embodiment, N refers to the number N of data lines which are used for charging multiple sub-pixels with different colors and are connected to one signal input terminal via the demutiplexer, and the demutiplexer circuit is represented as 1:N demux circuit.

In a case that the preset period is display time of N frames of image, ranks corresponding to time instants when turn-on levels occurs in the timing sequence control signals corresponding to the same data line in the N frames of image are different from each other. In each preset period, a sequence of turn-on levels occurring in the timing sequence control signals corresponding to the N data lines in one of any two frames of image is different from a sequence of the turn-on levels occurring in the timing sequence control signals corresponding to the N data lines in the other of the any two frames of image.

It should be illustrated that ranks corresponding to the time instants when turn-on levels occurs in timing sequence control signals corresponding to the same data line in the N frames of image are not limited in the embodiment, the ranks corresponding to the time instants when the turn-on levels occurs in the timing sequence control signals corresponding to the same data line in the N frames of image may be set in a certain sequence or may be set randomly.

In some embodiments, in each preset period, the rank corresponding to the time instant when the turn-on level occurs in the timing sequence control signal corresponding to the data line in an (i+1)-th frame of image is obtained by backward shifting, by one, the rank corresponding to the time instant when the turn-on level occurs in the timing sequence control signal corresponding to the same data line in an i-th frame of image in the sequence of the turn-on levels occurring in the timing sequence control signals corresponding to the N data lines in the i-th frame of image, where i=1~(N−1). Alternatively, in each preset period, the rank corresponding to the time instant when the turn-on level occurs in the timing sequence control signal corresponding to the data line in an (i+1)-th frame of image is obtained by forward shifting, by one, the rank corresponding to the time instant when the turn-on level occurs in the timing sequence control signal corresponding to the same data line in an i-th frame of image in the sequence of the turn-on levels occurring in the timing sequence control signals corresponding to the N data lines in the i-th frame of image, where i=~1(N−1). The rank in the sequence is shifted circularly, and a time difference between a time instant corresponding to one rank and a time instant corresponding to a rank adjacent to the one rank in the same sequence is one turn-on time period.

That is, it is assumed that ranks corresponding to time instants when the turn-on levels occurs in the timing sequence control signals corresponding to a first data line, a second data line, a third data line, . . . , an N-th data line in a first frame are denoted as first, second, third, . . . , N-th, ranks corresponding to time instants when the turn-on levels occurs in the timing sequence control signals corresponding to the first data line, the second data line, the third data line, . . . , the N-th data line in a second frame may be denoted as second, third, . . . , N-th, first, or N-th, first, second, . . . , (N−1)-th.

In other embodiment of the present disclosure, the ranks corresponding to the time instants when the turn-on levels occurs in the timing sequence control signals corresponding to the same data line in each preset period may be in other sequence, as long as the ranks corresponding to the time instants when the turn-on levels occurs in the timing sequence control signals corresponding to the same data line in any two adjacent frames are difference from each other. That is, in one preset period, that is, ranks corresponding to time instants when the turn-on levels occurs in the timing sequence control signals corresponding to each sub-pixel in the display time of N frames of image includes all of first, second, third, . . . N-th. It is assumed that a charging time period is NT in a case that a rank corresponding to a time instant when the turn-on level occurs in the timing sequence control signal is first, a charging time period is (N−1)T in a case that a rank corresponding to a time instant when the turn-on level occurs in the timing sequence control signal is second, and so forth, and a charging time period is T in a case that a rank corresponding to a time instant when the turn-on level occurs in the timing sequence control signal is N-th. In this way, a sum of the charging time periods of a sub-pixel is equal to a sum of the charging time periods of another sub-pixel in the N frames of image, and the sum of the charging time periods of each of the sub-pixels is equal to (1+2+3+ . . . +N)T.

In the embodiment of the present disclosure, the display time of N frames of image serves as a preset period, and the sub-pixels with the same color have the same charging time period, and the sub-pixels with different colors have the same charging time period, thereby solving the problem of vertical striping in the display panel caused in a case that the sub-pixels in different columns have different brightness with direct charging, while avoiding the color difference caused in a case that the sub-pixels with different colors have different charging time periods.

For convenience of illustrating the control method for the display panel according to the embodiment of the present disclosure, the embodiment of the present disclosure is illustrated with taking N=2 and N=3 as an example.

The pixels in the display panel according to the embodiment of the present disclosure are arranged as shown in FIG. 8. The display panel includes a first sub-pixel 31, a second sub-pixel 32 and a third sub-pixel 33, which correspond to the sub-pixel driving unit in FIG. 7. In the embodiment, the first sub-pixel 31 is a red pixel, the second sub-pixel 32 is a green pixel, and the third sub-pixel 33 is a blue pixel. The display panel includes a first sub-pixel row, a third sub-pixel row and a second sub-pixel row arranged sequentially along an extension direction (a direction Y in FIG. 8) of the data line. Along an extension direction (a direction X in FIG. 8) of the gate line, the first sub-pixel row includes multiple first sub-pixels 31, the second sub-pixel row includes multiple second sub-pixels 32 and the third sub-pixel row includes multiple third sub-pixels 33. The first sub-pixel 31 and the second sub-pixel 32 are arranged alternately along the extension direction (the direction Y in FIG. 8) of the data line. The third sub-pixel 33 is arranged between the first sub-pixel 31 and the second sub-pixel 32 along the extension direction (the direction X in FIG. 8) of the gate line.

Figure 10:
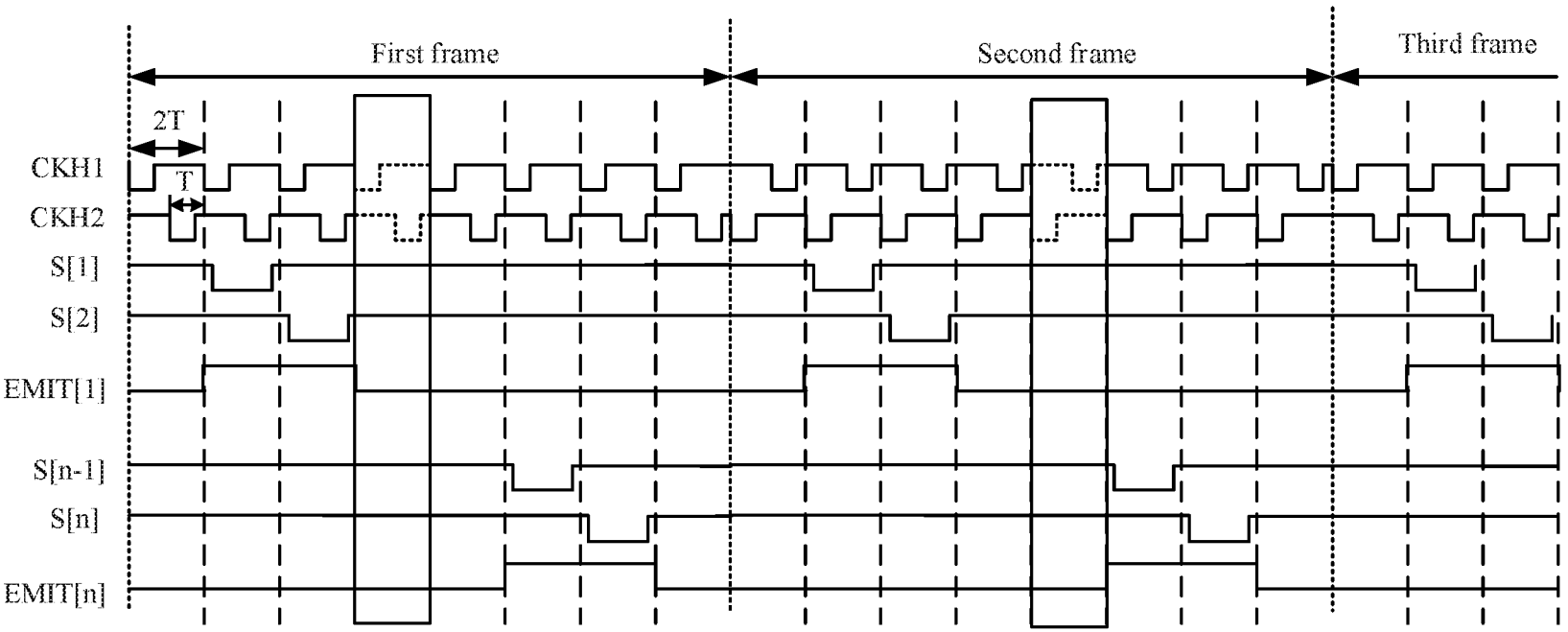
FIG. 10 is a schematic timing sequence diagram of a control method for a display panel including a 1:2 demux circuit according to an embodiment of the present disclosure.

With reference to FIG. 10, the demux circuit refers to a 1:2 circuit in a case of N=2, and the preset period is display time of two frames of image. No matter which color of a pixel is controlled by the data line connected to CKH1 and CKH2, a time instant when a signal is inputted into a data line connected to CKH1 is one turn-on time period earlier than a time instant when a signal is inputted into a data line connected to CKH2 in a first frame of image, in this case, it is assumed that a charging time period of a sub-pixel controlled by the data line connected to CKH1 is 2T and a charging time period of a sub-pixel controlled by the data line connected to CKH2 is 1T. A rank of inputting a signal into the data line connected to CKH1 in the second frame of image is different from a rank of inputting the signal into the data line connected to CKH1 in the first frame of image, and a rank of inputting a signal into the data line connected to CKH2 in the second frame of image is also different from a rank of inputting the signal into the data line connected to CKH2 in the first frame of image. In the second frame of image, a time instant when a signal is inputted into the data line connected to CKH1 is one turn-on time period later than a time instant when a signal is inputted into the data line connected to CKH2, a charging time period of the sub-pixel controlled by the data line connected to CKH1 is 1T, and a charging time period of the sub-pixel controlled by the data line connected to CKH2 is 2T In one preset period, a sum of the charging time periods of the sub-pixel controlled by the data line connected to CKH1 is 3T, and a sum of the charging time periods of the sub-pixel controlled by the data line connected to CKH2 is 3T. Therefore, no matter which color of the sub-pixel is controlled by the data line connected to CKH1 and CKH2, all sub-pixels have the same charging time period in one preset period.

In the embodiment, vertical striping occurs in a single odd frame of image, and vertical striping also occurs in a single even frame of image. Since an accumulation of brightness for a time period is perceived by human eyes, brightness of the vertical striping displayed in the odd frame of image and brightness of the vertical striping displayed in the even frame of image are compensated with each other in multiple frames of image. Therefore, brightness in the odd frame of image and brightness in the even frame of image are compensated with each other in a case that display time of two frames of image serves as the preset period, thereby eliminating the vertical striping in the display panel.

Figure 11:
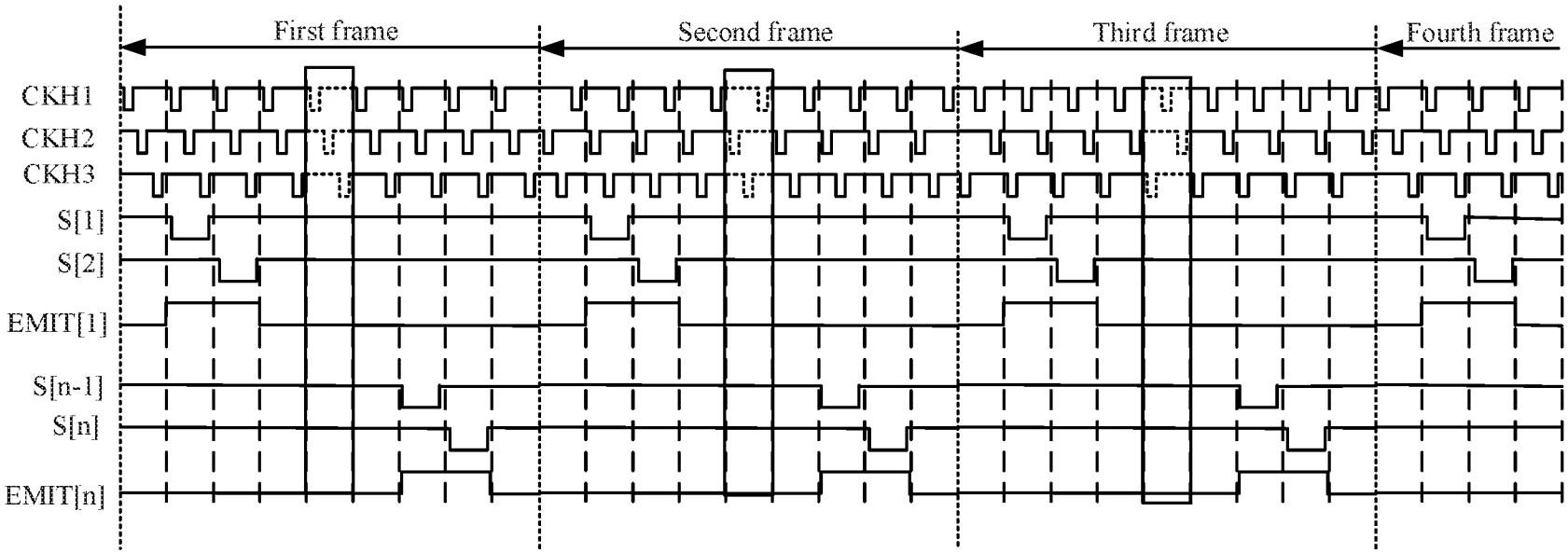
FIG. 11 is a schematic timing sequence diagram of another control method for a display panel including a 1:3 demux circuit according to an embodiment of the present disclosure.

With reference to FIG. 11, the demux circuit is a 1:3 circuit in a case of N=3. As similar to the principle in a case of N=2, it is assumed that, in a first frame of image, a charging time period of a sub-pixel controlled by a data line connected to CKH1 is 3T, and a charging time period of a sub-pixel controlled by a data line connected to CKH2 is 2T and a charging time period of a sub-pixel controlled by a data line connected to CKH3 is 1T. A sequence of charging for the data lines connected to CKH1, CKH2 and CKH3 is changed in a second frame of image, and a charging time period is changed accordingly. As shown in FIG. 11, in the second frame of image, a charging time period of the sub-pixel controlled by the data line connected to CKH1 is 1T, and a charging time period of the sub-pixel controlled by the data line connected to CKH2 is 3T, and a charging time period of the sub-pixel controlled by the data line connected to CKH3 is 2T. In the third frame of image, a charging time period of the sub-pixel controlled by the data line connected to CKH1 is 2T, and a charging time period of the sub-pixel controlled by the data line connected to CKH2 is 1T, and a charging time period of the sub-pixel controlled by the data line connected to CKH3 is 3T.

In a case that display time of three frames of image serves as the preset period, the charging time periods of the sub-pixels controlled by the data lines connected to CKH1, CKH2 and CKH3 are each 1T+2T+3T=6T in one preset period. That is, all sub-pixels have the same charging time period and have the same brightness in one preset period. Therefore, although vertical striping occurs in a single frame of image, brightness of all vertical striping is compensated with each other in one preset period, thereby eliminating the vertical striping in a whole preset period.

It can be seen from the examples that, in a case that the preset period in the embodiment of the present disclosure is the display time of N frames of image, the problem of vertical striping in display of the display panel with the direct charging in the conventional technology can also be solved.

It can be seen from the above embodiment that although the vertical striping is eliminated in a case that the display time of N frames of image serves as the preset period, vertical striping also occurs in a single frame of image. In order that no vertical striping occurs in any frame of image of the display panel, a control method for a display panel is further provided according to another embodiment of the present disclosure, in which the methods according to the above two embodiments are combined. That is, in a case that the display time of N frames of image serves as the preset period, all the sub-pixels with different colors have the same charging time period in the display time of N frames of image, and the sub-pixels with the same color have the same charging time period in a single frame of image.

Figure 12:
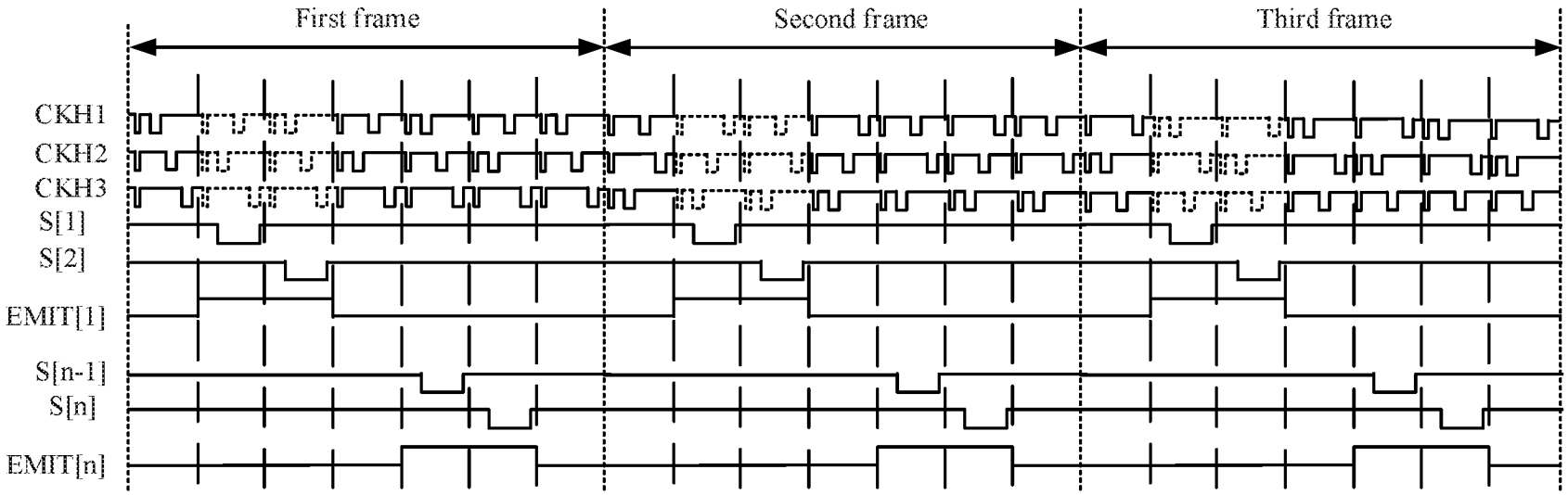
FIG. 12 is a schematic timing sequence diagram of another control method for a display panel including a 1:3 demux circuit according to an embodiment of the present disclosure.

With reference to the timing sequence diagram shown in FIG. 12, and in conjunction with the pixel arrangement shown in FIG. 7, since the demux circuit is a 1:3 circuit, that is, N=3, display time of three frames of image serves as a preset period.

In a first frame of image, a rank of charging the green sub-pixel controlled by the data line connected to CKH3 in a sequence of charging the red sub-pixel, the blue sub-pixel and the green sub-pixel is third, and a charging time period of the green sub-pixel is shorter than charging time periods of the red sub-pixel and the blue sub-pixel. The red sub-pixel and the blue sub-pixel are respectively controlled by the data line connected to CKH1 and the data line connected to CKH2. A rank of the turn-on levels occurring in CKH1 in the sequence is exchanged with a rank of the turn-on levels occurring in CKH2 in the sequence when switching between a step of scanning the gate line in the odd row and a step of scanning the gate line in the even row, in this way, the charging time period of the blue sub-pixel B driving unit>the charging time period of the red sub-pixel R driving unit>the charging time period of the green sub-pixel G driving unit, and it is assumed that the charging time period of the blue sub-pixel is 3T, the charging time period of the red sub-pixel is 2T and the charging time period of the green sub-pixel is 1T.

In a second frame of image, a rank of charging the green sub-pixel controlled by the data line connected to CKH3 in a sequence of charging the red sub-pixel, the blue sub-pixel and the green sub-pixel is first, and a charging time period of the green sub-pixel is longer than charging time periods of the red sub-pixel and the blue sub-pixel. The red sub-pixel and the blue sub-pixel are respectively controlled by the data line connected to CKH1 and the data line connected to CKH2. A rank of the turn-on levels occurring in CKH1 in the sequence is exchanged with a rank of the turn-on levels occurring in CKH2 in the sequence when switching between a step of scanning the gate line in the odd row and a step of scanning the gate line in the even row, in this way, the charging time period of the green sub-pixel G driving unit>the charging time period of the blue sub-pixel B driving unit>the charging time period of the red sub-pixel R driving unit, that is, the charging time period of the blue sub-pixel is 2T, the charging time period of the red sub-pixel is 1T and the charging time period of the green sub-pixel is 3T.

In a third frame of image, a rank of charging the green sub-pixel controlled by the data line connected to CKH3 in a sequence of charging the red sub-pixel, the blue sub-pixel and the green sub-pixel is second, and a charging time period of the green sub-pixel is between charging time periods of the red sub-pixel and the blue sub-pixel. The red sub-pixel and the blue sub-pixel are respectively controlled by the data line connected to CKH1 and the data line connected to CKH2. A rank of the turn-on levels occurring in CKH1 in the sequence is exchanged with a rank of the turn-on levels occurring in CKH2 in the sequence when switching between a step of scanning the gate line in the odd row and a step of scanning the gate line in the even row, in this way, the charging time period of the red sub-pixel R driving unit>the charging time period of the green sub-pixel G driving unit>the charging time period of the blue sub-pixel B driving unit, that is, the charging time period of the blue sub-pixel is 1T, the charging time period of the red sub-pixel is 3T and the charging time period of the green sub-pixel is 2T.

In the three frames of image, that is, in one preset period, a sum of the charging time periods of the blue sub-pixel is (3+2+1)T=6T, a sum of the charging time periods of the red sub-pixel is (2+1+3)T=6T, and a sum of the charging time periods of the green sub-pixel is (1+3 2)T=6T.

That is, the display time of three frames of image serve as the preset period in the 1:3 demux circuit according to the embodiment, ranks corresponding to time instants when the turn-on levels occurs in the timing sequence control signals corresponding to the same data line in three frames of image are different from each other, and in the preset period, a sequence of the turn-on levels occurring in the timing sequence control signals corresponding to the three data lines in one of any two frames of image is different from a sequence of the turn-on levels occurring in the timing sequence control signals corresponding to the three data lines in the other of the any two frames of image. The sub-pixels with the same color have the same charging time period in a single frame of image, so that no vertical striping occurs in the single frame of image. Also, the sub-pixels with different colors have the same charging time period in the three frames of image, thereby avoiding the color difference in display for a long time.

It should be illustrated that, for the pixel driving device according to the present disclosure shown in FIG. 7, an embodiment is also provided based on the concept of the present disclosure, to simplify a timing sequence control diagram of the display panel. Display time of two frames of image may also serve as the preset period in the 1:3 demux circuit, to compensate brightness of the sub-pixels, with reference to the timing sequence diagram in FIG. 13 and the structure of the pixel driving device shown in FIG. 7.

In a first frame of image, a rank of charging the green sub-pixel controlled by the data line connected to CKH3 in a sequence of charging the red sub-pixel, the blue sub-pixel and the green sub-pixel is second, and a charging time period of the green sub-pixel is between charging time periods of the red sub-pixel and the blue sub-pixel. The red sub-pixel and the blue sub-pixel are respectively controlled by the data line connected to CKH1 and the data line connected to CKH2. A rank of the turn-on levels occurring in CKH1 in the sequence is exchanged with a rank of the turn-on levels occurring in CKH2 in the sequence when switching between a step of scanning the gate line in the odd row and a step of scanning the gate line in the even row, in this way, the charging time period of the blue sub-pixel B driving unit>the charging time period of the green sub-pixel G driving unit>the charging time period of the red sub-pixel R driving unit, that is, the charging time period of the blue sub-pixel is 3T, the charging time period of the red sub-pixel is 1T and the charging time period of the green sub-pixel is 2T.

In a second frame of image, a rank of charging the green sub-pixel controlled by the data line connected to CKH3 in a sequence of charging the red sub-pixel, the blue sub-pixel and the green sub-pixel is second, and a charging time period of the green sub-pixel is between charging time periods of the red sub-pixel and the blue sub-pixel. The red sub-pixel and the blue sub-pixel are respectively controlled by the data line connected to CKH1 and the data line connected to CKH2. A rank of the turn-on levels occurring in CKH1 in the sequence is exchanged with a rank of the turn-on levels occurring in CKH2 in the sequence when switching between a step of scanning the gate line in the odd row and a step of scanning the gate line in the even row, in this way, the charging time period of the red sub-pixel R driving unit>the charging time period of the green sub-pixel G driving unit>the charging time period of the blue sub-pixel B driving unit, that is, the charging time period of the blue sub-pixel is 1T, the charging time period of the red sub-pixel is 3T and the charging time period of the green sub-pixel is 2T.

In the two frames of image, that is, in one preset period, a sum of the charging time periods of the blue sub-pixel is (3+1)T=4T, a sum of the charging time periods of the red sub-pixel is (1+3)T=4T, and a sum of the charging time periods of the green sub-pixel is (2+2)T=4T.

That is, the display time of two frames of image serve as the preset period in the 1:3 demux circuit according to the embodiment, the sub-pixels with the same color have the same charging time period in a single frame of image, so that no vertical striping occurs in the single frame of image, and in two frames of image, a sum of the charging time periods of the sub-pixel is equal to a sum of the charging time periods of another sub-pixel with a different color from the sub-pixel, thereby avoiding color difference in display for a long time.

Figure 13:
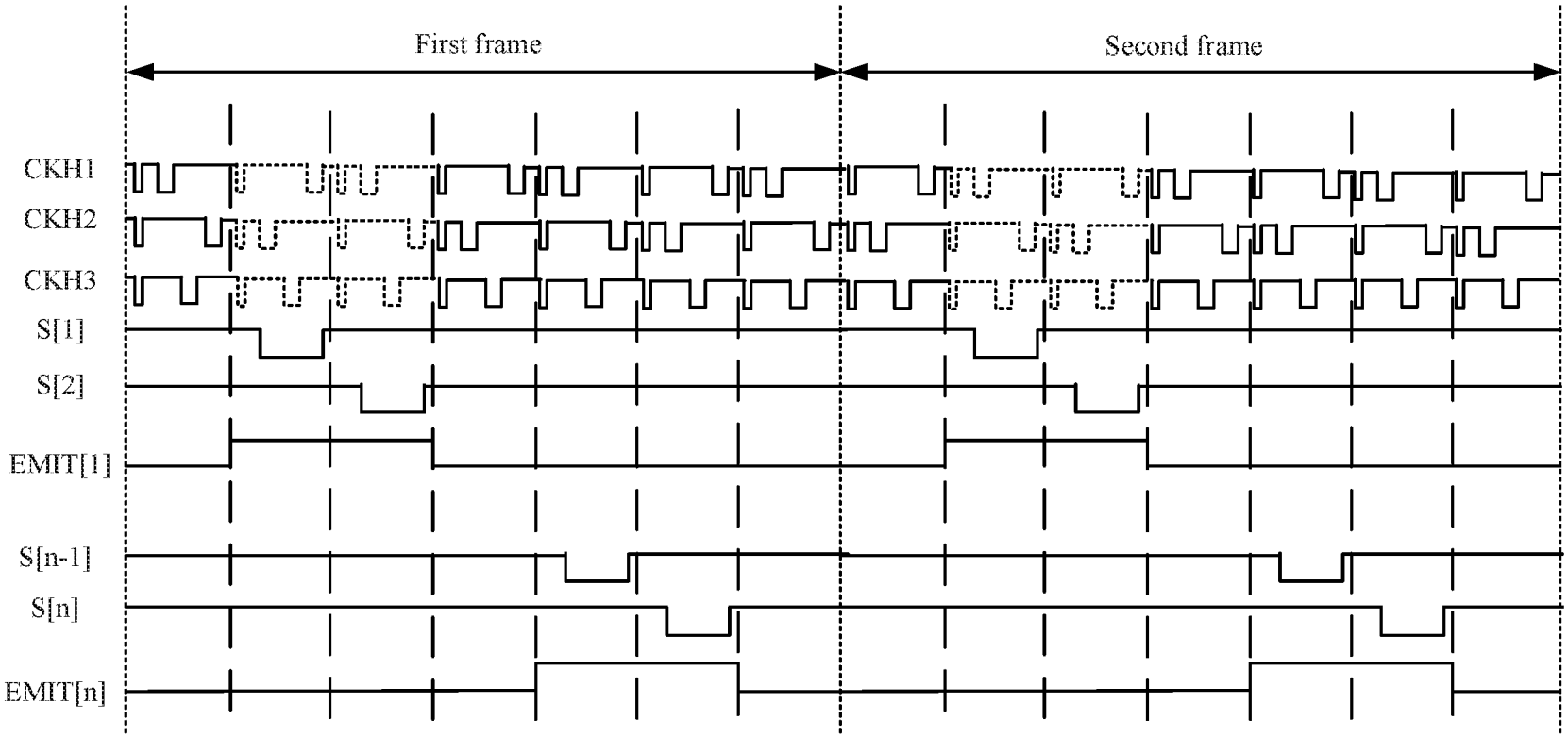
FIG. 13 is a schematic timing sequence diagram of another control method for a display panel including a 1:3 demux circuit according to an embodiment of the present disclosure.

It should be illustrated that in the embodiments of the present disclosure, a reset voltage is provided to the data line connected to each of the sub-pixels before the gate line in each row is scanned with a scanning signal, to pre-charge the multiple sub-pixels connected to the demultiplexer. With reference to FIG. 9, FIG. 12 and FIG. 13, a low level is provided to the CKH signal line before each of gate lines S[1], S[2] . . . S[n] in a row is scanned with a low level, for pre-charging the CKH signal line. A start time when a CKH signal line is pre-charged and a duration of pre-charging the CKH signal line are the same as a start time when another CKH signal line is pre-charged and a duration of pre-charging the another CKH signal line, so that the data line is reset before scanning the gate line, thereby avoiding abnormal display of the sub-pixel caused after a different voltage is provided to the data line. It should be illustrated that, there is also a duration of pre-charging in a practical operation in FIG. 10 and FIG. 11, the duration of pre-charging is omitted for convenience of illustrating a tuning sequence of the CKH signal lines in the embodiment of the present to disclosure, however, which is not intended to limit the embodiment of the present disclosure.

It should be illustrated that the embodiments in the specification are described in a progressive way, and each embodiment lays emphasis on differences from other embodiments. For the same or similar parts between various embodiments, one may refer to the description of other embodiments.

The invention claimed is:

1. A control method for a display panel, the display panel comprising:

a plurality of gate lines, a plurality of data lines arranged to intersect with the plurality of gate lines in an insulative manner, and a plurality of sub-pixels arranged in an array, wherein sub-pixels with different colors from each other connected to same gate line constitute a repeat unit; and a demultiplexer, wherein N data lines for charging the sub-pixels with different colors from each other are connected to one signal input terminal through the demultiplexer, wherein N is an integer greater than 1, and the control method comprising:

providing a scanning signal to a gate line in each row to perform progressive scan; and turning on the demultiplexer to charge sub-pixels connected to the demultiplexer when the scanning signal is inputted, wherein timing sequence control signals corresponding to the data lines have a same turn-on duration, and sub-pixels with a same color have a same charging time period in a preset period, and a sequence of turn-on levels occurring in the timing sequence control signals corresponding to the data lines is changed at least once in the preset period, wherein the preset period is display time of one frame of image, and the display panel further comprises a pixel driving device, and the pixel driving device comprises a first sub-pixel driving unit, a second sub-pixel driving unit and a third sub-pixel driving unit, a first sub-pixel driving unit row and a second sub-pixel driving unit row are arranged alternately in an extension direction of the data line, the first sub-pixel driving unit row comprises the first sub-pixel driving unit, the second sub-pixel driving unit and the third sub-pixel driving unit arranged sequentially in an extension direction of the gate line, the second sub-pixel driving unit row comprises the third sub-pixel driving unit, the second sub-pixel driving unit and the first sub-pixel driving unit arranged sequentially in the extension direction of the gate line, the first sub-pixel driving unit in the first sub-pixel driving unit row and the third sub pixel driving unit in the second sub-pixel driving unit row are arranged alternately in the extension direction of the data line, and three data lines for charging the first sub-pixel driving unit the second sub-pixel driving unit and the third sub-pixel driving unit in the first sub-pixel driving unit row are connected to one signal input terminal via one demultiplexer; and the control method further comprises:

during scanning the gate line in an odd row and the gate line in an even row, keeping an unchanged rank of a turn-on level occurring in the timing sequence control signal corresponding to the data line for charging the second sub-pixel driving unit in the first sub-pixel driving unit row in a sequence of turn-on levels occurring in the timing sequence control signals corresponding to the data lines for charging the first sub-pixel driving unit, the second sub-pixel driving unit and the third sub-pixel driving unit;

when switching between an operation of scanning the gate line in an odd row and an operation of scanning the gate line in an even row, exchanging a rank of a turn-on level occurring in the timing sequence control signal corresponding to the data line for charging the first sub-pixel driving unit in the first sub-pixel driving unit row in the sequence with a rank of a turn-on level occurring in the timing sequence control signal corresponding to the data line for charging the third sub-pixel driving unit in the first sub-pixel driving unit row in the sequence.

2. The control method for the display panel according to claim 1, wherein the sequence of the turn-on levels occurring in the timing sequence control signals corresponding to the data lines for charging the first sub-pixel driving unit, the second sub-pixel driving unit and the third sub-pixel driving unit in the first sub-pixel driving unit row in the demultiplexer is that:

the turn-on level occurs firstly in the timing sequence control signal corresponding to the data line for charging the first sub-pixel driving unit;

the turn-on level occurs secondly in the timing sequence control signal corresponding to the data line for charging the second sub-pixel driving unit; and the turn-on level occurs thirdly in the timing sequence control signal corresponding to the data line for charging the third sub-pixel driving unit.

3. The control method for the display panel according to claim 1, wherein the sequence of the turn-on levels occurring in the timing sequence control signals corresponding to the data lines for charging the first sub-pixel driving unit, the second sub-pixel driving unit and the third sub-pixel driving unit in the first sub-pixel driving unit row in the demultiplexer is that:

the turn-on level occurs firstly in the timing sequence control signal corresponding to the data line for charging the second sub-pixel driving unit;

the turn-on level occurs secondly in the timing sequence control signal corresponding to the data line for charging the first sub-pixel driving unit; and the turn-on level occurs thirdly in the timing sequence control signal corresponding to the data line for charging the third sub-pixel driving unit.

4. The control method for the display panel according to claim 1, wherein the sequence of the turn-on levels occurring in the timing sequence control signals corresponding to the data lines for charging the first sub-pixel driving unit, the second sub-pixel driving unit and the third sub-pixel driving unit in the first sub-pixel driving unit row in the demultiplexer is that:

the turn-on level occurs firstly in the timing sequence control signal corresponding to the data line for charging the first sub-pixel driving unit;

the turn-on level occurs secondly in the timing sequence control signal corresponding to the data line for charging the third sub-pixel driving unit; and the turn-on level occurs thirdly in the timing sequence control signal corresponding to the data line for charging the second sub-pixel driving unit.

5. The control method for the display panel according to claim 1, wherein the first sub-pixel driving unit is a red pixel driving unit, the second sub-pixel driving unit is a green pixel driving unit and the third sub-pixel driving unit is a blue pixel driving unit.

6. The control method for the display panel according to claim 5, wherein the display panel comprises a first sub-pixel, a second sub-pixel and a third sub-pixel, and the first sub-pixel is a red pixel, the second sub-pixel is a green pixel and the third sub-pixel is a blue pixel, the display panel comprises a first sub-pixel row, a third sub-pixel row and a second sub-pixel row arranged sequentially in the extension direction of the data line;

the first sub-pixel row comprises a plurality of first sub-pixels, the second sub-pixel row comprises a plurality of second sub-pixels and the third sub-pixel row comprises a plurality of third sub-pixels, in the extension direction of the gate line;

the first sub-pixel and the second sub-pixel are arranged alternately in the extension direction of the data line, and the third sub-pixel is arranged between the first sub-pixel and the second sub-pixel in the extension direction of the gate line.

7. The control method for the display panel according to claim 1, before providing the scanning signal to the gate line in each row to perform progressive scan, further comprising:

providing a reset voltage to all of the data lines connected to the sub-pixels, to pre-charge the sub-pixels connected to the demultiplexer.

8. A control method for a display panel, the display panel comprising:

a plurality of gate lines, a plurality of data lines arranged to intersect with the plurality of gate lines in an insulative manner, and a plurality of sub-pixels arranged in an array, wherein sub-pixels with different colors from each other connected to same gate line constitute a repeat unit; and a demultiplexer, wherein N data lines for charging the sub-pixels with different colors from each other are connected to one signal input terminal through the demultiplexer, wherein N is an integer greater than 1, and the control method comprising:

providing a scanning signal to a gate line in each row to perform progressive scan; and turning on the demultiplexer to charge sub-pixels connected to the demultiplexer when the scanning signal is inputted, wherein timing sequence control signals corresponding to the data lines have a same turn-on duration, and sub-pixels with a same color have a same charging time period in a preset period, and a sequence of turn-on levels occurring in the timing sequence control signals corresponding to the data lines is changed at least once in the preset period, wherein the preset period is display time of N frames of image;

ranks corresponding to time instants when turn-on levels occurs in the timing sequence control signals corresponding to the same data line in the N frames of image are different from each other; and in each preset period, a sequence of turn-on levels occurring in the timing sequence control signals corresponding to the N data lines in one of any two frames of image is different from a sequence of turn-on levels occurring in the timing sequence control signals corresponding to the N data lines in the other of the any two frames of image.

9. The control method for the display panel according to claim 8, wherein in each preset period, the rank corresponding to the time instant when the turn-on level occurs in the timing sequence control signal corresponding to the data line in an (i+1)-th frame of image is obtained by backward shifting, by one, the rank corresponding to the time instant when the turn-on level occurs in the timing sequence control signal corresponding to the same data line in an i-th frame of image in the sequence of the turn-on levels occurring in the timing sequence control signals corresponding to the N data lines in the i-th frame of image, wherein i=1~(N−1), wherein the rank in the sequence is shifted circularly, and a time difference between a time instant corresponding to one rank and a time instant corresponding to a rank adjacent to the one rank in a same sequence is one turn-on time period.

10. The control method for the display panel according to claim 8, wherein in each preset period, the rank corresponding to the time instant when the turn-on level occurs in the timing sequence control signal corresponding to the data line in an (i+1)-th frame of image is obtained by forward shifting, by one, the rank corresponding to the time instant when the turn-on level occurs in the timing sequence control signal corresponding to the same data line in an i-th frame of image in the sequence of the turn-on levels occurring in the timing sequence control signals corresponding to the N data lines in the i-th frame of image, wherein i=1~(N−1), wherein the rank in the sequence is shifted circularly, and a time difference between a time instant corresponding to one rank and a time instant corresponding to a rank adjacent to the one rank in a same sequence is one turn-on time period.

11. The control method for the display panel according to claim 8, wherein N equals to 2.

12. The control method for the display panel according to claim 8, wherein N equals to 3.

13. The control method for the display panel according to claim 8, wherein the display panel comprises a first sub-pixel, a second sub-pixel and a third sub-pixel, and the first sub-pixel is a red pixel, the second sub-pixel is a green pixel, and the third sub-pixel is a blue pixel, the display panel comprises a first sub-pixel row, a third sub-pixel row and a second sub-pixel row arranged sequentially in an extension direction of the data line;

the first sub-pixel row comprises a plurality of first sub-pixels, the second sub-pixel row comprises a plurality of second sub-pixels, and the third sub-pixel row comprises a plurality of third sub-pixels, in an extension direction of the gate line;

the first sub-pixel and the second sub-pixel are arranged alternately in the extension direction of the data line, and the third sub-pixel is arranged between the first sub-pixel and the second sub-pixel in the extension direction of the gate line.

14. The control method for the display panel according to claim 8, wherein the sub-pixels with the same color have the same charging time period in each frame of image.

15. The control method for the display panel according to claim 8, before providing the scanning signal to the gate line in each row to perform progressive scan, further comprising:

providing a reset voltage to all of the data lines connected to the sub-pixels, to pre-charge the sub-pixels connected to the demultiplexer.

16. A control method for a display panel, the display panel comprising:

a plurality of gate lines, a plurality of data lines arranged to intersect with the plurality of gate lines in an insulative manner, and a plurality of sub-pixels arranged in an array, wherein sub-pixels with different colors from each other connected to same gate line constitute a repeat unit; and a demultiplexer, wherein N data lines for charging the sub-pixels with different colors from each other are connected to one signal input terminal through the demultiplexer, wherein N is an integer greater than 1, and the control method comprising:

providing a scanning signal to a gate line in each row to perform progressive scan; and turning on the demultiplexer to charge sub-pixels connected to the demultiplexer when the scanning signal is inputted, wherein timing sequence control signals corresponding to the data lines have a same turn-on duration, and sub-pixels with a same color have a same charging time period in a preset period, and a sequence of turn-on levels occurring in the timing sequence control signals corresponding to the data lines is changed at least once in the preset period, wherein the display panel further comprises a pixel driving device, and the pixel driving device comprises a first sub-pixel driving unit, a second sub-pixel driving unit and a third sub-pixel driving unit, a first sub-pixel driving unit row and a second sub-pixel driving unit row are arranged alternately in an extension direction of the data line, the first sub-pixel driving unit row comprises the first sub-pixel driving unit, the second sub-pixel driving unit and the third sub-pixel driving unit arranged sequentially in an extension direction of the gate line, the second sub-pixel driving unit row comprises the third sub-pixel driving unit, the second sub-pixel driving unit and the first sub-pixel driving unit arranged sequentially in the extension direction of the gate line, the first sub-pixel driving unit in the first sub-pixel driving unit row and the third sub-pixel driving unit in the second sub-pixel driving unit row are arranged alternately in the extension direction of the data line, and three data lines for charging the first sub-pixel driving unit, the second sub-pixel driving unit and the third sub-pixel driving unit in the first sub-pixel driving unit row are connected to one signal input terminal via one demultiplexer; and the control method further comprises: with taking display time of two frames of image as the preset period, in adjacent two frames of image, keeping an unchanged rank of a turn-on level occurring in the timing sequence control signal corresponding to the data line for charging the second sub-pixel driving unit in the first sub-pixel driving unit row in a sequence of turn-on levels occurring in the timing sequence control signals corresponding to the data lines for charging the first sub-pixel driving unit, the second sub-pixel driving unit and the third sub-pixel driving unit in the first sub-pixel driving unit row, when switching between an odd frame of image and an even frame of image, exchanging a rank of a turn-on level occurring in the timing sequence control signal corresponding to the data line for charging the first sub-pixel driving unit in the first sub-pixel driving unit row in the sequence with a rank of a turn-on level occurring in the timing sequence control signal corresponding to the data line for charging the third sub-pixel driving unit in the first sub-pixel driving unit row in the sequence, wherein the sequence of the turn-on levels occurring in the timing sequence control signals corresponding to the data lines for charging the first sub-pixel driving unit, the second sub-pixel driving unit and the third sub-pixel driving unit in the first sub-pixel driving unit row in the demultiplexer is that: the rank of the turn-on level occurring in the timing sequence control signal corresponding to the data line for charging the second sub-pixel driving unit is between the rank of the turn-on level occurring in the timing sequence control signal corresponding to the data line for charging the first sub-pixel driving unit and the rank of the turn-on level occurring in the timing sequence control signal corresponding to the data line for charging the third sub-pixel driving unit.

17. The control method for the display panel according to claim 16, further comprising:

before providing the scanning signal to the gate line in each row to perform progressive scan, providing a reset voltage to all of the data lines connected to the sub-pixels, to pre-charge the sub-pixels connected to the demultiplexer.

* * * * *